US006755382B1

(12) United States Patent
Melnick

(10) Patent No.: US 6,755,382 B1
(45) Date of Patent: Jun. 29, 2004

(54) DUAL RETRACTABLE TISSUE ROLL HOLDER

(76) Inventor: Philip Melnick, 536 Leavenworth St., Apt. 1006, San Francisco, CA (US) 94109

( * ) Notice: Subject to any disclaimer, the term of this patent is extended or adjusted under 35 U.S.C. 154(b) by 0 days.

(21) Appl. No.: 09/629,207

(22) Filed: Jul. 31, 2000

(51) Int. Cl.[7] ..... A47F 5/00; B65H 18/04

(52) U.S. Cl. ..... 248/316.8; 248/316.5; 242/596.1

(58) Field of Search ..... 248/316.8, 364, 248/316.5, 316.7; 242/596.1–596.7, 423.1, 596.8, 591, 599, 598.2

(56) References Cited

U.S. PATENT DOCUMENTS 2,021,417 A * 11/1935 Hoffman ..... 242/596.3
3,088,686 A * 5/1963 Curry ..... 242/596.1
3,317,150 A * 5/1967 Summersby ..... 242/564
3,643,884 A * 2/1972 Curtin ..... 242/55.2
4,097,002 A * 6/1978 Krueger ..... 242/596.1
4,105,168 A * 8/1978 Rutherford ..... 242/55.2
4,493,445 A * 1/1985 Arthur ..... 223/68
5,222,678 A * 6/1993 Carrington ..... 242/55.2
5,265,779 A * 11/1993 Jiang ..... 223/68
5,444,899 A * 8/1995 Koppelomaki ..... 24/625
5,662,288 A * 9/1997 Chiang ..... 242/596.8
5,868,344 A * 2/1999 Melnick ..... 242/591
5,878,976 A * 3/1999 Duck ..... 242/596.1
5,950,961 A * 9/1999 Duck ..... 242/596.1

* cited by examiner

*Primary Examiner*—Daniel P. Stodola
*Assistant Examiner*—Khoa Tran
(74) *Attorney, Agent, or Firm*—Thomas M. Freiburger

(57) ABSTRACT

A paper tissue roll holder eliminates the use of a spindle. Two opposed arms with slidable back frames have support plugs or protrusions extending inwardly from ends of the arms, to engage in the ends of a tissue paper roll. The frames move laterally in opposition to one another in a slide track of a housing. In one preferred embodiment both slidable frames have gear racks which engage with a single rotatable gear positioned in the center of a back plate of the housing. Movement of either of the arms and frames causes opposite movement in unison by the other frame, by virtue of the mechanical linkage provided by the gear. This allows clearance for center loading of a tissue paper roll.

1 Claim, 5 Drawing Sheets

DUAL RETRACTABLE TISSUE ROLL HOLDER

BACKGROUND OF THE INVENTION

The invention relates to a gear activated paper tissue roll holder which functions without the use of a spindle.

Most paper tissue roll holders prior to this invention have employed a spindle to hold the tissue roll in place. Some spindles are detachable, can come apart and are difficult to use for people with disabilities, including arthritis. The spindles actually are not needed, since support plugs engaging in each end of the tissue core can be sufficient for holding a tissue roll in place, as is well known. Further, spindles can be removed and lost, another disadvantage for the hotel industry.

Several prior art paper tissue roll holders have offered an alternative to the use of a spindle. Some have claimed to be dual retractable, yet require two hands to operate; some have one frame which remains stationary as another frame is pulled out to the side, requiring off-center loading, followed by shifting the tissue roll to the side.

A principal object of the present invention is to provide a tissue holder which can be center loaded, more quickly and easily than in the prior art, with only one hand needed to manipulate the holder.

SUMMARY OF THE INVENTION

In accordance with this invention, a paper tissue roll holder is easily operated with one hand. The holder device has a mechanical linkage such that when one arm of the holder is pulled outwardly, the other is moved outwardly in the opposite direction. Preferably a knob is provided on the outside of one arm of the tissue roll holder for gripping by the user. Each arm is connected to a back portion comprising a frame or bracket which extends at about right angles from the back end of the arm and which is generally parallel to the wall on which the unit is to be mounted. In one embodiment each of these back frames has a gear rack, and each gear rack engages with a gear positioned between the two racks and mounted for rotation in the unit's housing. This causes motion of-the one arm to be transferred to opposing motion of the opposite arm. In another embodiment, the opposing motion of the two arms is achieved with two enmeshed gears, each connected to a pivotal lever that engages with one of the slidable frames.

DESCRIPTION OF PREFERRED EMBODIMENTS

Figure 1:
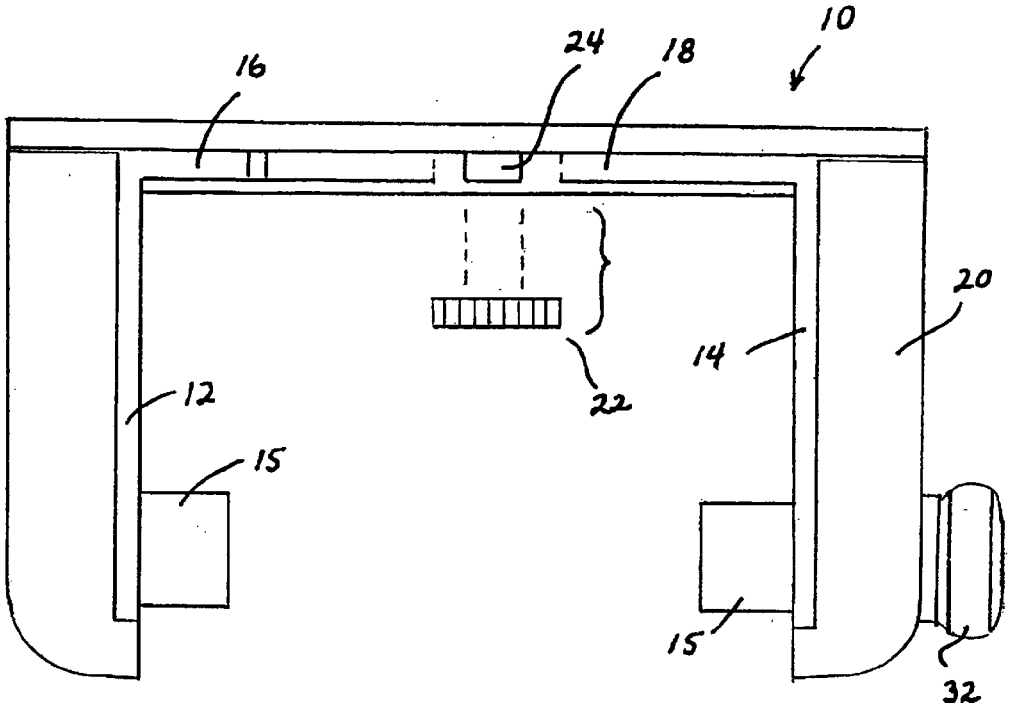
FIG. 1 is a top view, exploded, showing a paper tissue roll holder of the invention and indicating a gear which fits over a shaft centered in a back plate.
Figure 2:
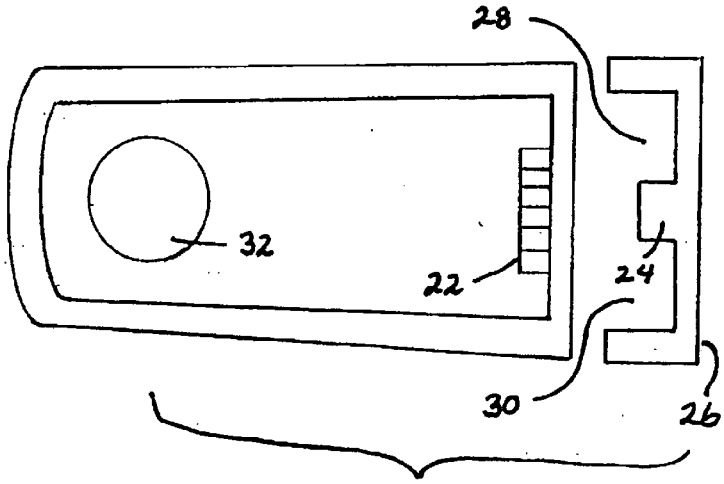
FIG. 2 is a right side elevation view of the device, also showing the gear.
Figure 3:
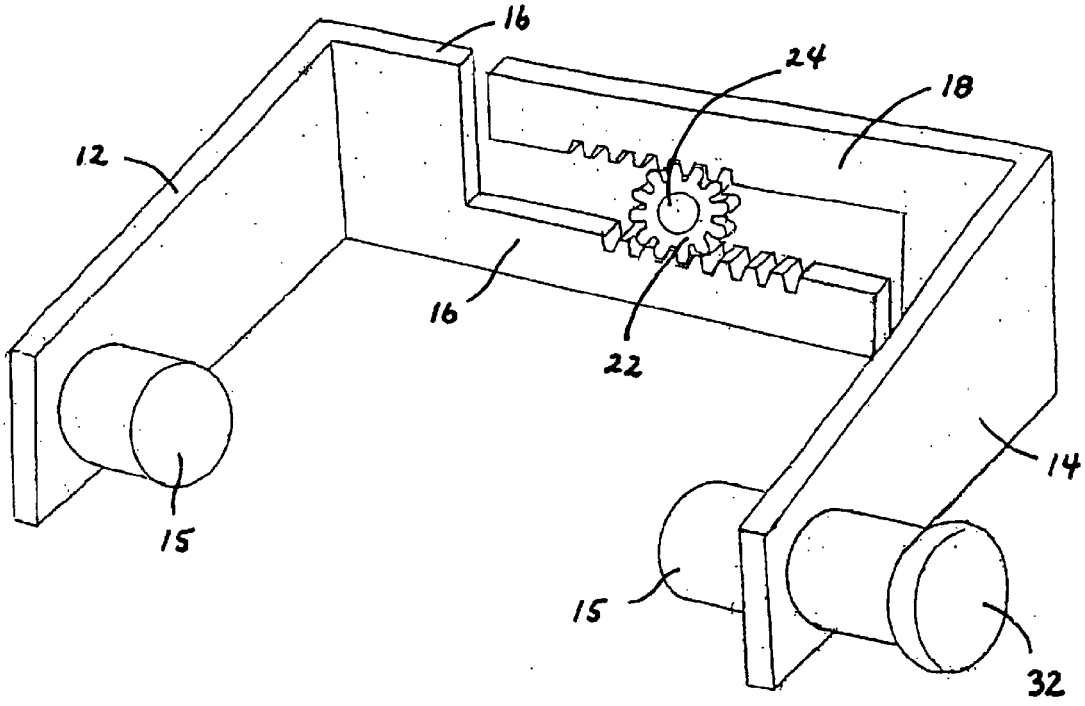
FIG. 3 is a top frontal perspective view showing operative portions of the tissue roll holder device, including the gear.
Figure 4:
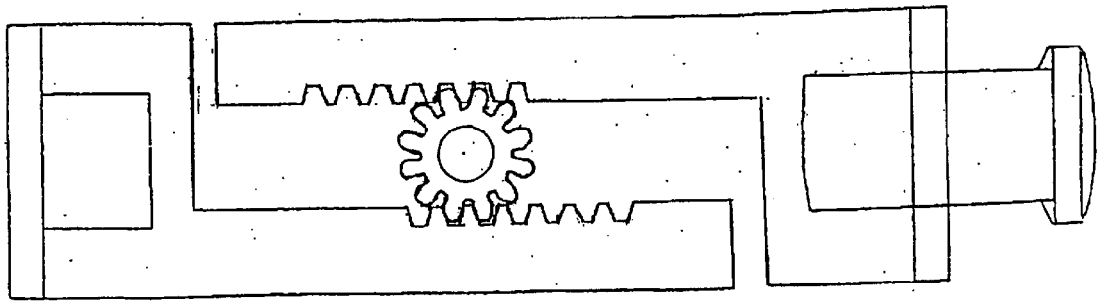
FIG. 4 is a front elevation view showing the components of FIG. 3.
Figure 5:
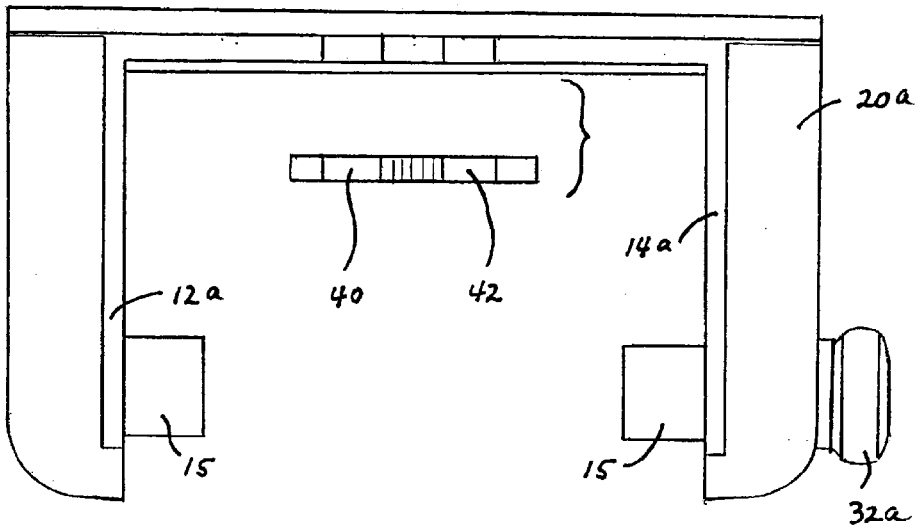
FIG. 5 is a plan view showing a second embodiment of a paper tissue roll holder of the invention.
Figure 6:
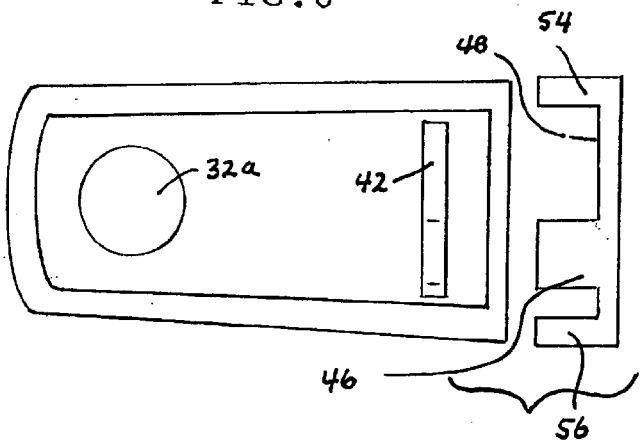
FIG. 6 is a side elevation view, exploded, showing an arm linkage mechanism of the second embodiment.

FIG. 1 shows in plan view a paper tissue roll holder 10 of the invention. The tissue roll holder includes a pair of arms 12 and 14 at opposed position relative to one another, each having near an outer end a support plug or protrusion 15 as shown. Each arm is secured to, shown integral with, a bracket or a frame 16, 18, generally at right angles to the arm, forming an L shaped arm-frame member. The two frames or brackets are parallel to one another and parallel to a wall on which the device 10 is to be mounted. A housing for the device is shown at 20, and portions of this housing are removed to reveal inner components. Specifically, a gear 22 is shown and indicated as to assembly on a short shaft 24 which is integral with a back plate 26 seen in FIG. 2. The shaft 24 is centered in the back plate 26, as can be seen in FIGS. 2 and 4. Further, this back plate has two tracks 28 which support the frames 16 and 18, for lateral movement left or right, as can be envisioned from FIGS. 3 and 4.

A manual gripping knob 32 is secured to one of the two arms and extends out of the housing 20 as shown in FIG. 1, for enabling a user to operate the device. When the knob 32 is pulled outwardly, this moves the arm 14 and attached frame 18 to the right as seen in the figures, which also causes the arm 12 and frame 16 to move to the left, in unison with movement of the arm 14. This moves the two support plugs or protrusions 15 farther apart, enabling a tissue paper roll to be removed and replaced. The rotation of the gear 22 on the shaft 24 effects this simultaneous movement.

Figure 7:
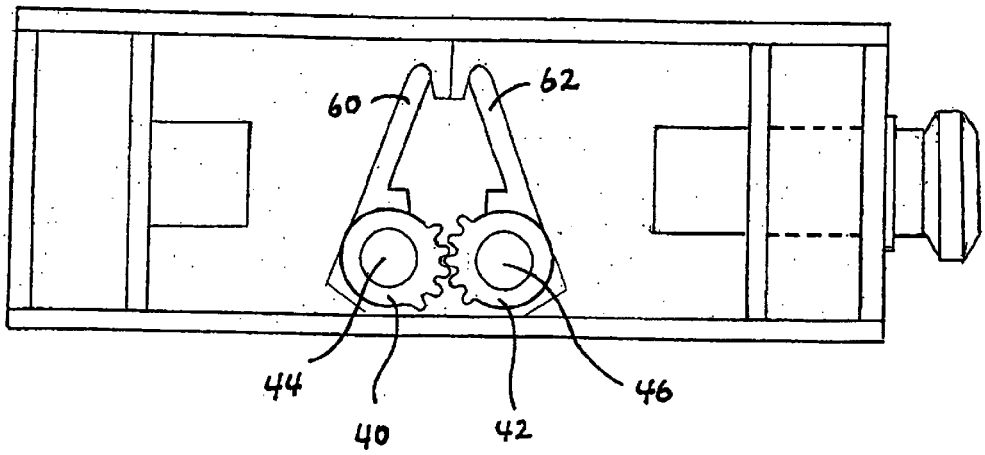
FIG. 7 is a frontal view with a portion of the housing removed, showing the second embodiment with mechanical linkage, in a position with arms of the device closed for retaining a tissue roll.
Figure 8:
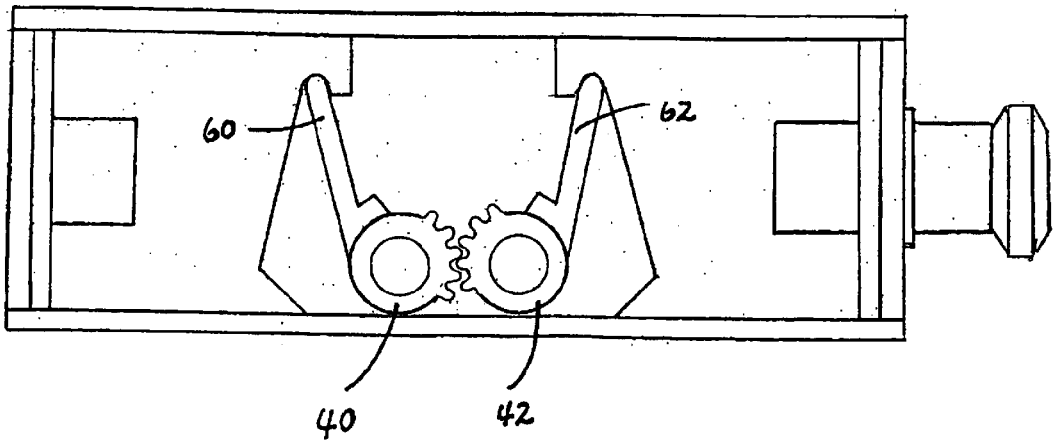
FIG. 8 is a view similar to FIG. 7, but with the arms moved outwardly, to the open position.
Figure 9:
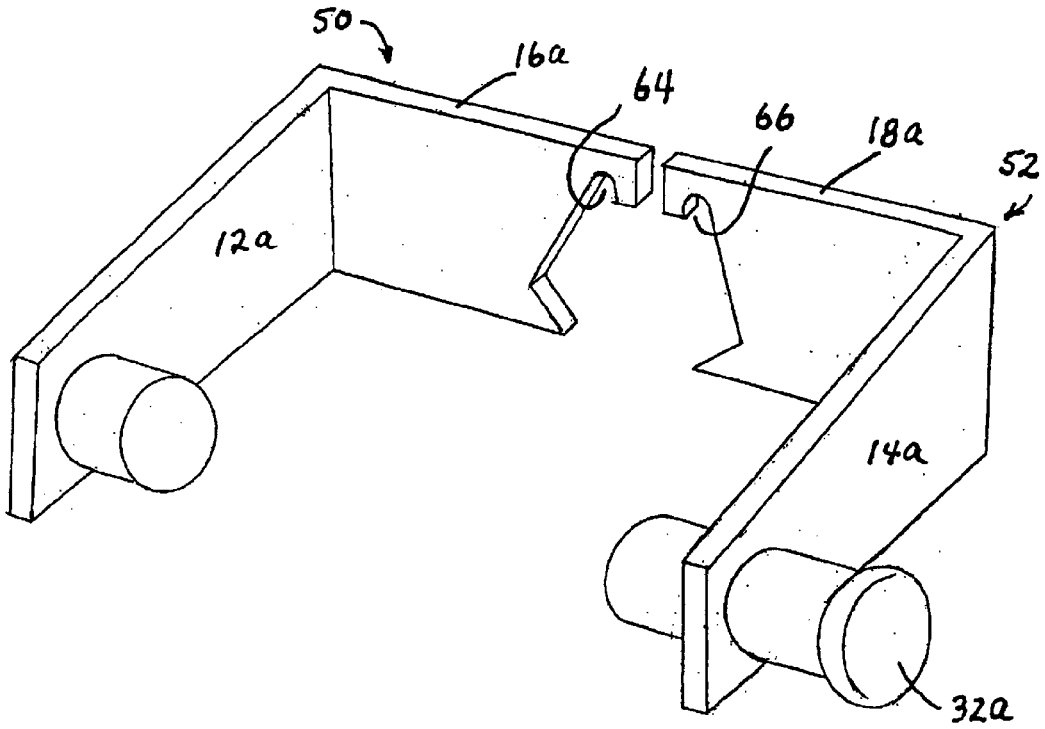
FIG. 9 is a frontal perspective view showing arms and back frame members of the device of FIGS. 5–8.
Figure 10:
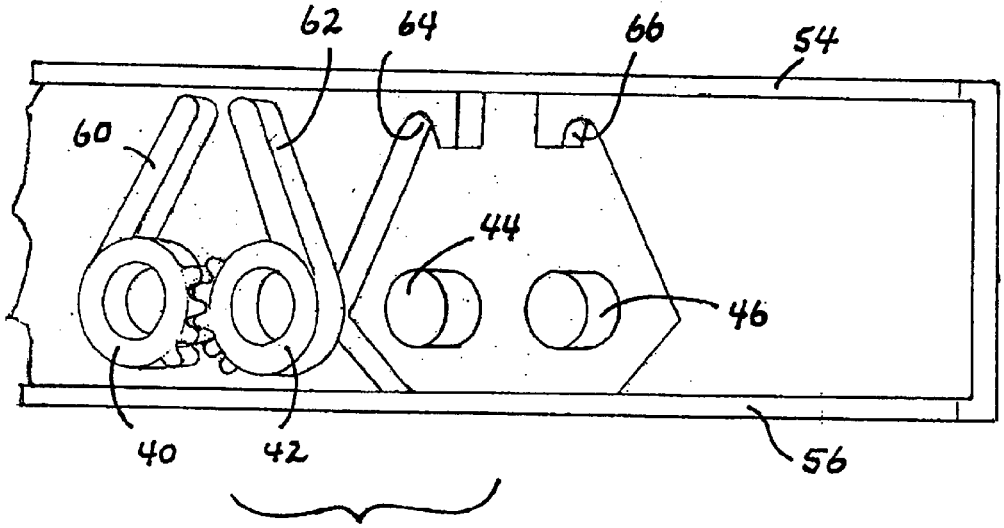
FIG. 10 is an exploded view in perspective, showing a portion of the housing and a pair of gear lever members providing mechanical linkage between the two arms.

FIGS. 5–10 show a second embodiment in which the mechanical linkage between the arms is formed in a different way. Two levered gears 40 and 42 rotate on two shafts 44 and 46 that extend forward from a back plate 48 best seen in FIG. 6. The device has two arms 12*a* and 14*a* similar to those of the first embodiment, with plugs or protrusions 15. The arms are connected to frames or brackets 16*a*, 18*a* in L-shaped arm-frame structures 50 and 52 as best seen in FIG. 9. These L-shaped structures 50 and 52 are held in place by tracks defined by upper and lower edges 54 and 56 of the back plate 48. Again, a manual gripping knob 32*a* is connected to the arm 14*a* and positioned at the outside of the device's housing 20*a* as shown. Pulling or pushing of the knob moves both arms in unison, as indicated in FIGS. 7 and 8 and as apparent from the mechanical linkage illustrated between the two sliding frames 16*a*, 18*a*, effected by the lever gears 40 and 42, via ends of the levers 60, 62 extending into recesses 64, 66 of the sliding frames as shown.

I claim:

1. A paper tissue roll holder, comprising:

a back plate, a pair of back frame members at opposed and overlapping positions alongside the back plate, the back frame members being generally coplanar with one another and in a plane generally parallel to the back plate, the two back frame members being mounted on the back plate for sliding movement toward and away from one another, each back frame member having an arm extending at approximately right angles from an outer end of the back frame member, out of said plane of the back frame members, and each arm having near an outer end of the arm a projection extending toward the other arm and capable of fitting into an end of a tissue roll so as to support the tissue roll between the arms, and mechanical linkage means comprising a rotatable gear mounted on the back plate, and each back frame member having a gear rack enmeshed with the rotatable gear, the two racks being at opposed sides of the rotatable gear, such that when one arm and rack are moved laterally, the other arm and rack are caused to move in unison in the opposite direction, whereby a paper tissue roll can be removed and replaced using only one hand to manipulate the tissue roll holder.

* * * * *